US007730682B2

(12) United States Patent
Nash

(10) Patent No.: US 7,730,682 B2
(45) Date of Patent: Jun. 8, 2010

(54) PARTITION MOUNTING SYSTEM AND CLAMP ASSEMBLY FOR MOUNTING PARTITION

(75) Inventor: Alan C. Nash, Milwaukee, WI (US)

(73) Assignee: R&B Wagner, Inc., Butler, WI (US)

( * ) Notice: Subject to any disclaimer, the term of this patent is extended or adjusted under 35 U.S.C. 154(b) by 543 days.

(21) Appl. No.: 11/832,996

(22) Filed: Aug. 2, 2007

(65) Prior Publication Data

US 2009/0031653 A1 Feb. 5, 2009

(51) Int. Cl.
*E04H 1/00* (2006.01)
*E04C 2/38* (2006.01)

(52) U.S. Cl. ..... 52/238.1; 52/800.16; 52/800.18; 52/239; 52/127.8

(58) Field of Classification Search ..... 52/238.1, 52/127.8, 127.11, 127.12, 239, 240, 241, 52/242, 243, 243.1, 210, 213, 217, 204.5, 52/204.56, 204.72, 204.71, 800.16, 800.18, 52/800.15; 49/380, 413
See application file for complete search history.

(56) References Cited

U.S. PATENT DOCUMENTS 2,169,713 A * 8/1939 Stroud ..... 52/204.595
4,103,874 A * 8/1978 Horgan, Jr. ..... 256/24
4,423,582 A 1/1984 Yates et al.
4,671,016 A * 6/1987 Boeckx ..... 49/501
4,680,903 A * 7/1987 Horgan, Jr. ..... 52/127.8
4,763,453 A * 8/1988 Horgan, Jr. ..... 52/127.8
4,837,993 A 6/1989 Studenski
4,920,717 A 5/1990 Hooper, Jr.
5,069,010 A * 12/1991 Trainor et al. ..... 52/127.8
5,205,099 A * 4/1993 Grunhage et al. ..... 52/204.5
5,239,778 A 8/1993 Towler
5,275,074 A * 1/1994 Taylor et al. ..... 83/425
5,339,583 A * 8/1994 Hrdlicka et al. ..... 52/204.53
6,419,209 B1 7/2002 Shepherd (Continued)

FOREIGN PATENT DOCUMENTS

JP 2000-64732 A 2/2000

OTHER PUBLICATIONS

International Search Report and Written Opinion for PCT/US2008/064692, PCT Application claiming priority to the same US patent application as the present application.

*Primary Examiner*—Richard E Chilcot, Jr.
*Assistant Examiner*—Mark R Wendell
(74) *Attorney, Agent, or Firm*—Nicholas A. Kees; Godfrey & Kahn, S.C.

(57) ABSTRACT

A system for mounting a partition, the system including a shoe with a slot for receiving an edge of the partition and an isolator that fits within the slot between the partition and a portion of the slot. A clamp assembly fits within the slot opposite the first isolator. The clamp assembly includes upper and lower blocks and, optionally, a center block. Surfaces of the blocks are angled with respect to each other so that drawing the upper and lower blocks toward each other will urge one of the blocks in one direction and the other block or blocks in the opposite direction. The blocks include engagement surfaces which engage a side wall of the slot and a side of the partition to selectively and releasably hold the partition within the slot.

20 Claims, 12 Drawing Sheets

U.S. PATENT DOCUMENTS

| | | | | |
|---|---|---|---|---|
| 6,434,905 | B1 * | 8/2002 | Sprague | 52/474 |
| 6,517,056 | B2 * | 2/2003 | Shepherd | 256/24 |
| 6,543,956 | B2 * | 4/2003 | Schwarzbich | 403/167 |
| 6,912,818 | B2 * | 7/2005 | Sprague | 52/208 |
| 7,036,799 | B2 | 5/2006 | Shepherd | |
| 7,272,913 | B2 * | 9/2007 | Mitchell | 52/235 |
| 7,380,378 | B2 * | 6/2008 | Clifford et al. | 52/204.72 |
| 7,434,790 | B1 * | 10/2008 | Hansen | 256/24 |
| 7,454,867 | B2 * | 11/2008 | Nicoletti | 52/238.1 |
| 7,516,583 | B2 * | 4/2009 | Mitchell | 52/235 |
| 7,584,588 | B2 * | 9/2009 | Kim | 52/800.14 |
| 7,614,191 | B2 * | 11/2009 | Mitchell | 52/235 |
| 7,624,549 | B2 * | 12/2009 | Kopish | 52/243.1 |
| 2003/0024182 | A1 * | 2/2003 | Yeany | 52/204.67 |
| 2009/0241445 | A1 * | 10/2009 | Sprague | 52/243.1 |

* cited by examiner

FIG. 15
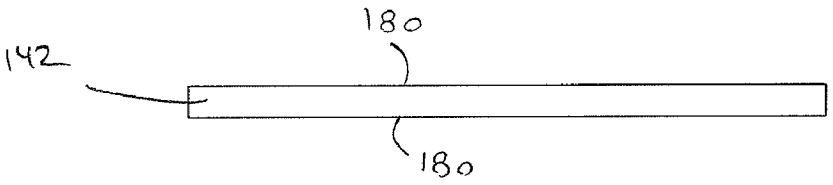
FIG. 14
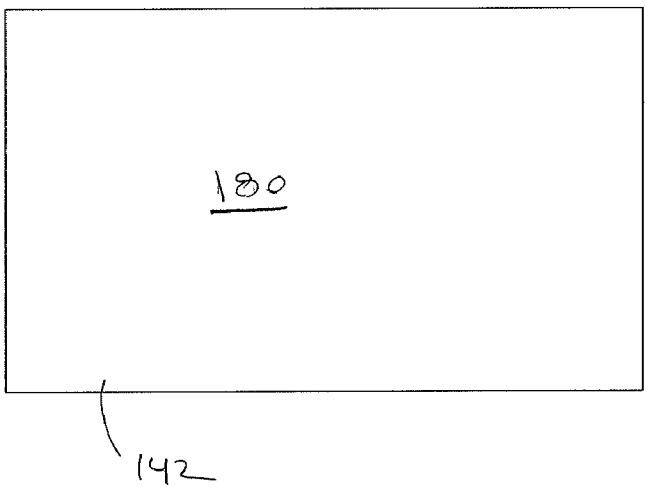
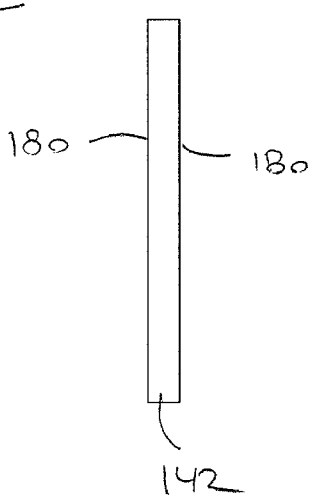
FIG. 16

PARTITION MOUNTING SYSTEM AND CLAMP ASSEMBLY FOR MOUNTING PARTITION

TECHNICAL FIELD

The present disclosure relates generally to mounting systems and clamp assemblies for mounting partitions.

BACKGROUND

It is conventional to use glass or glass-like transparent or semi-transparent partitions as part of a guard rail, hand rail or other railing for a stair or for a walkway. To mount these partitions securely without damaging the glass itself has always been an issue with installation of such partitions. In addition, it may be desirable to provide for removal of the partition without damaging the partition for repair or replacement at some future date.

One conventional system for installing and removably securing partitions in such applications is shown in U.S. Pat. No. 7,036,799, the disclosure of which is incorporated herein by reference. This system for securing partitions does provide secure installation but has shortcomings with regard to the method and means for installing and securing a partition, and the method, means and tools available to permit the partition's removal once installed.

Improvements to the above-referenced system and other known approaches to installing and removably securing partitions are desirable.

SUMMARY

The present disclosure relates to a system for mounting a partition. The system includes a shoe with a slot for receiving an edge of the partition and an isolator that fits within the slot between the partition and a portion of the slot. A clamp system fits within the slot opposite the first isolator. The clamp system includes upper and lower blocks and, optionally, a center block. Surfaces of the blocks are angled with respect to each other so that drawing the upper and lower blocks toward each other will urge one of the blocks in one direction and the other block or blocks in the opposite direction. The clamp system includes engagement surfaces which engage a side wall of the slot and a side of the partition to selectively and releasably hold the partition within the slot.

BRIEF DESCRIPTION OF THE DRAWINGS

The accompanying drawing figures, which are incorporated in and constitute a part of the description, illustrate several aspects of the invention and together with the description, serve to explain the principles of the invention. A brief description of the figures is as follows:

FIG. 14 is a side view of a second isolator of the partition clamping system of FIG. 1.

FIG. 15 is a top view of the second isolator of FIG. 14.

FIG. 16 is an end view of the second isolator of FIG. 14.

DETAILED DESCRIPTION

Figure 1:
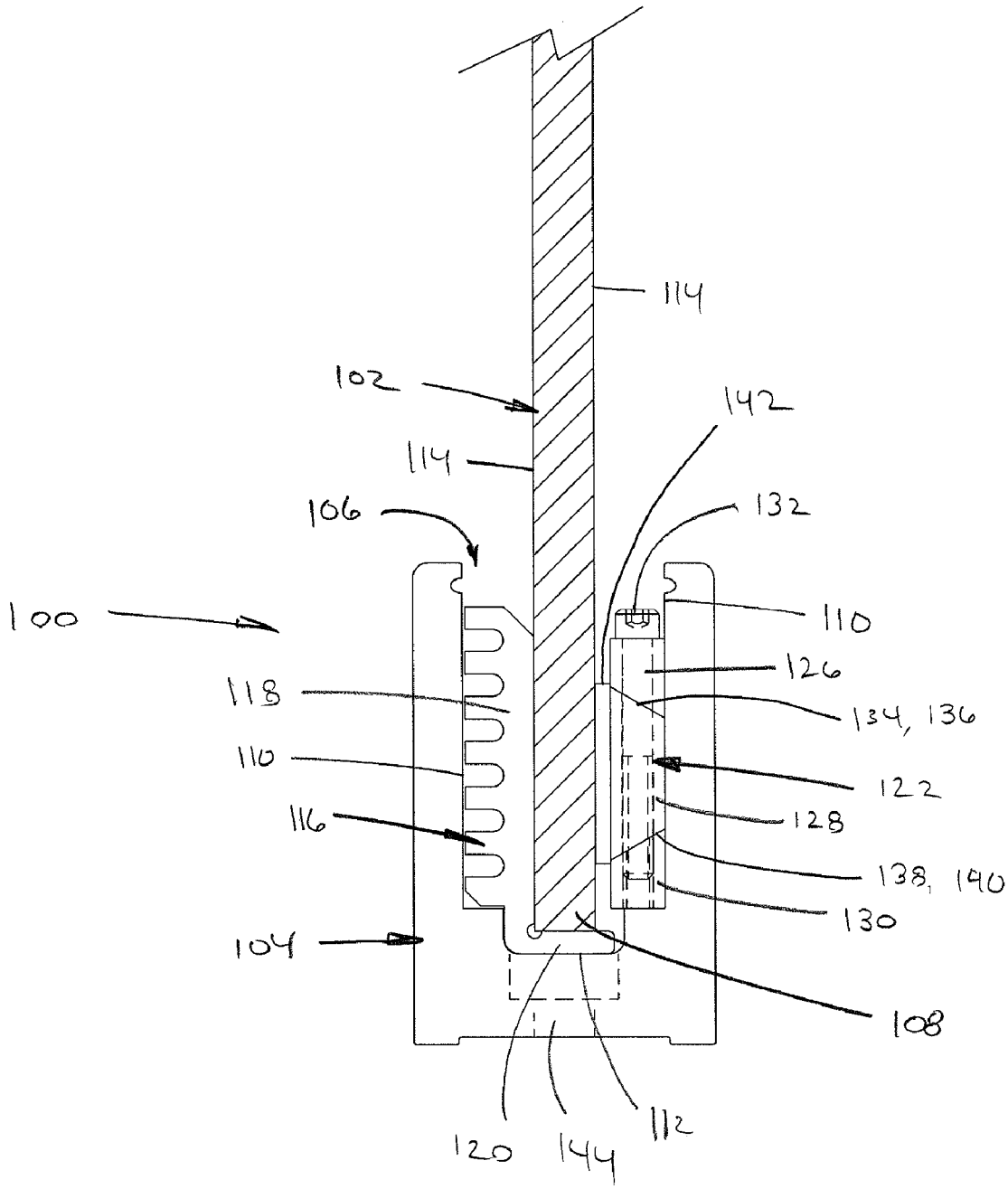
FIG. 1 is an end cross-sectional view of a partition clamping system according to the present disclosure.

Reference will now be made in detail to exemplary aspects of the present invention which are illustrated in the accompanying drawings. Wherever possible, the same reference numbers will be used throughout the drawings to refer to the same or like parts.

Referring now to FIGS. 1, and 20 to 23, a system 100 for clamping a partition 102, such as for use in a hand rail, guard rail or other railing system, into a base or shoe 104 is shown. Shoe 104 defines a slot 106 within which a lower edge 108 of partition 102 is received. Slot 106 includes a pair of opposing interior side walls 110 and a lower wall 112. Partition 102 includes a pair of opposing sides 114 adjacent lower edge 108. Within slot 106 between one of the sides 114 and one of the side walls 110 is at least a portion of a first isolator 116. Isolator 116 may include a vertical portion 118 (between side 114 and side wall 110) and a lower portion 120 (between lower edge 108 and lower wall 112).

Between opposite side 114 and side wall 110, a clamp assembly 122 is positioned within slot 106. Clamp assembly 122 is configured to be selectively expandable to provide force against both side wall 110 and side 114. Such force may act upon a second isolator 142 to apply pressure against side 114 of partition 102 and prevent removal of partition 102 from slot 106 of shoe 104. Clamp assembly 122 may include an upper block 126, a center block 128 and a lower block 130, with a screw 132 extending generally vertically through all three blocks. An upper surface 134 of center block 128 and a lower surface 136 of upper block 126 are sloped with respect to horizontal and may be generally sloped the same degree. A lower surface 138 of center block 128 and an upper surface 140 of lower block 130 are sloped with respect to horizontal and may be generally sloped the same degree.

Having the upper and lower sloped surfaces of center block 128 sloped oppositely, as shown, use of screw 132 to pull upper block 126 toward lower block 130 will urge center block 128 toward partition 102. Upper and lower blocks 126 and 130 will also be urged toward the adjacent side wall 110 of shoe 104. A second isolator 142 may be positioned between center block 128 and side 114 of partition 102.

Cooperation between isolators 118 and 142, and clamp assembly 122 may allow partition 102 to be laterally positioned as desired within slot 106. As shown, partition 102 is generally centered within slot 106. It may be desirable to have partition 102 centered, or offset closer to one or the other of the side walls 110 and manipulation of the thickness of the isolators may be permit some degree of offset.

Isolators 118 and 142 may be preferably made of a malleable material that may conform to the surface of sides 114 of partition 102. Use of such compliant materials for the isolators will permit more durable and rigid materials to be used to form clamp assembly 122 as these harder materials are not in contact with the material of partition 102 and thus cannot scar, scratch, score or otherwise harm the aesthetics or integrity of the partition. An opening 144 may be provided within slot 106 for receiving fasteners to secure the shoe to a desired location. Alternatively, the shoe may be configured to be mounted by any number of permanent or removable means without departing from the scope of the present disclosure.

Figure 2:
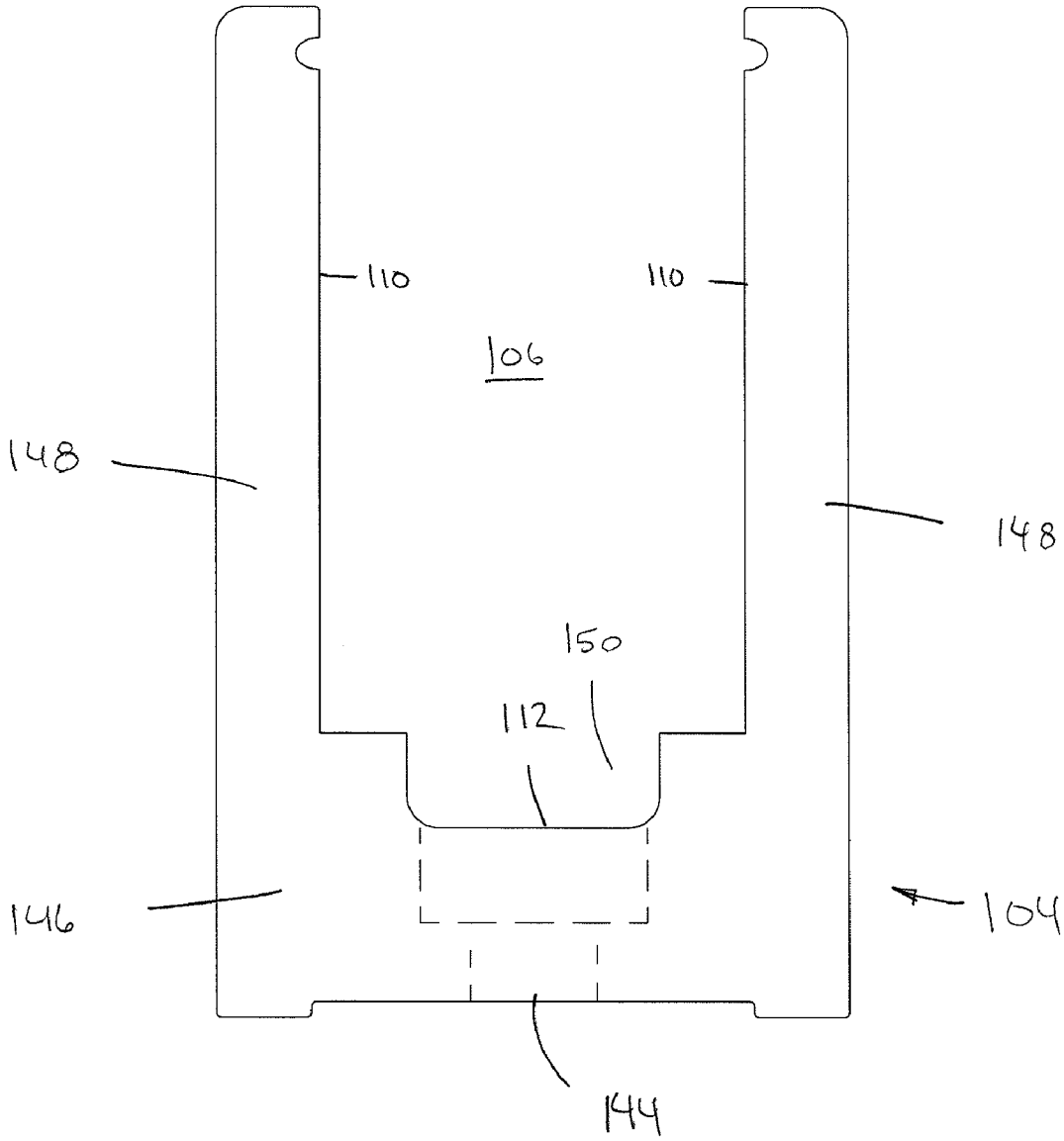
FIG. 2 is an end view of a partition mounting shoe of the partition clamping system of FIG. 1.

Referring now to FIG. 2, shoe 104 may include a base 146, with lower wall 112 and a fastener opening 144 extending therethrough, and a pair of upward extensions 148 of which side walls 110 define inner surfaces thereof. The spacing between side walls 110 may be varied as need to accommodate different widths of partition 102 and of isolators 118 and 142. Lower wall 112 may be within a recess 150 within slot 106 or the lower wall may form the entire bottom of slot 106. Shoe 104 extends perpendicularly to the cross-sectional view shown in FIGS. 1 and 2. Such extension is similar to conventional mounting bases or shoes for mounting partitions. Only the cross-section of shoe 104 is illustrated herein to convey the unique aspects of the present disclosure.

Figure 4:
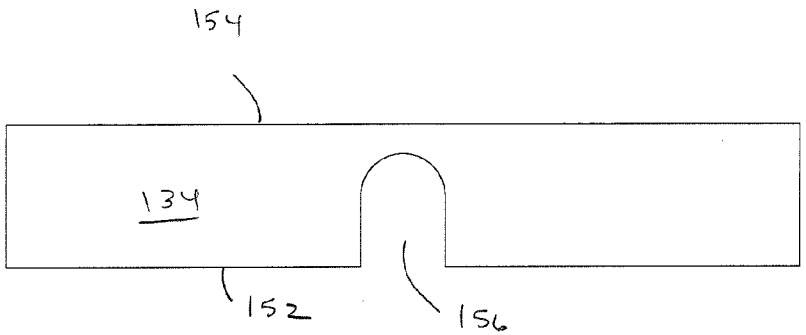
FIG. 4 is a top view of the center block of FIG. 3.
Figure 3:
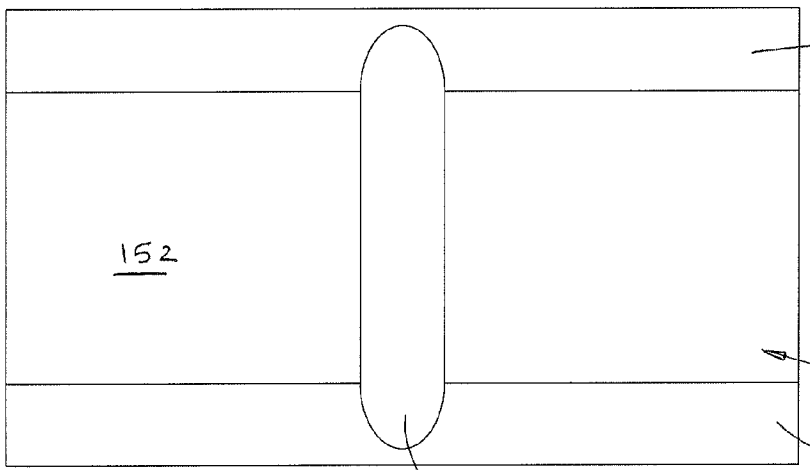
FIG. 3 is a side view of a center block of the partition clamping system of FIG. 1.
Figure 5:
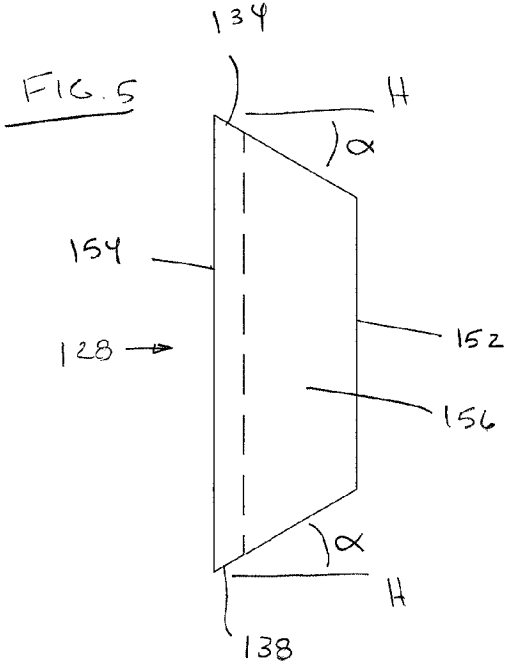
FIG. 5 is an end view of the center block of FIG. 3.

Referring now to FIGS. 3 to 5, center block 128 includes a first side 152 and a second side 154. First side 152 may include a groove or recess 156 for receiving screw 132. While groove 156 is shown as an open sided recess, such an open form is not necessary. An opening elongated between toward the first and second sides that will permit center block 128 to move in the direction of either side 152 or 154 when the position of upper and lower blocks is altered may also permit the clamp assembly according to the present disclosure to function as described herein. Second side 154 also defines an engagement surface that engages and applies pressure against the partition, either directly or indirectly through an isolator.

As shown in FIG. 5, upper surface 134 and lower surface 138 are angled with respect to a horizontal line (labeled H in the FIG.). This angle (labeled $\alpha$) is preferably generally the same for both surfaces, although the angles are defined in opposing directions. The angles of the two different surfaces may also be different from each other within the scope of the present disclosure. Angle $\alpha$ is shown as approximately thirty degrees, although other similar angles may be used within the scope of the present disclosure.

Figure 8:
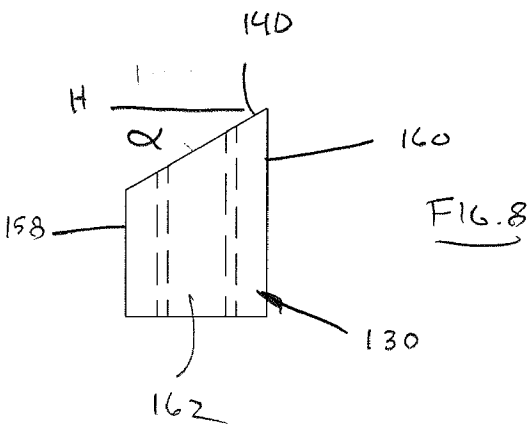
FIG. 8 is an end view of the lower block of FIG. 6.
Figure 7:
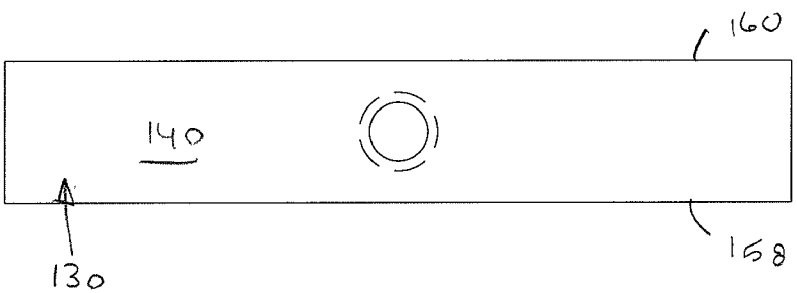
FIG. 7 is a top view of the lower block of FIG. 6.
Figure 6:
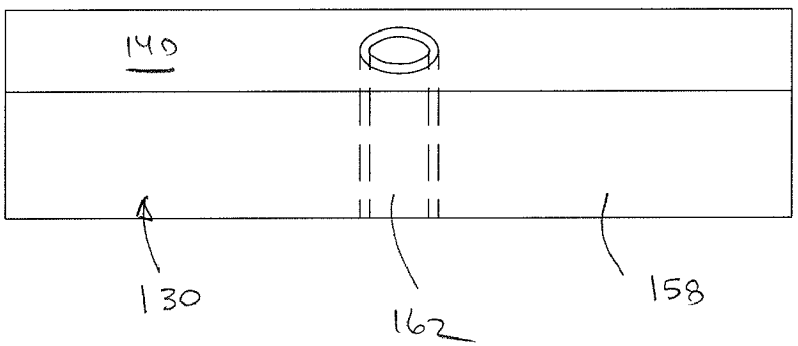
FIG. 6 is a side view of a lower block of the partition clamping system of FIG. 1.

Referring now to FIGS. 6 to 8, lower block 130 includes a first side 158 and a second side 160. Second side 160 also defines an engagement surface to engage side walls 110 within slot 106. A threaded opening 162 is provided through upper surface 140 to receive a threaded lower end of screw 132. Upper surface 140 is angled at generally the same angle $\alpha$ with horizontal H, as shown in FIG. 8.

Figure 9:
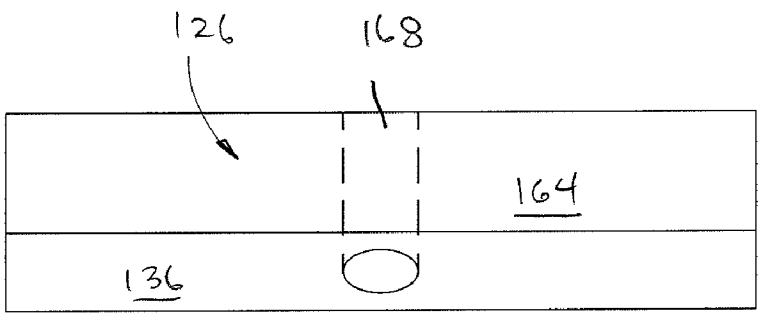
FIG. 9 is a side view of an upper block of the partition clamping system of FIG. 1.
Figure 10:
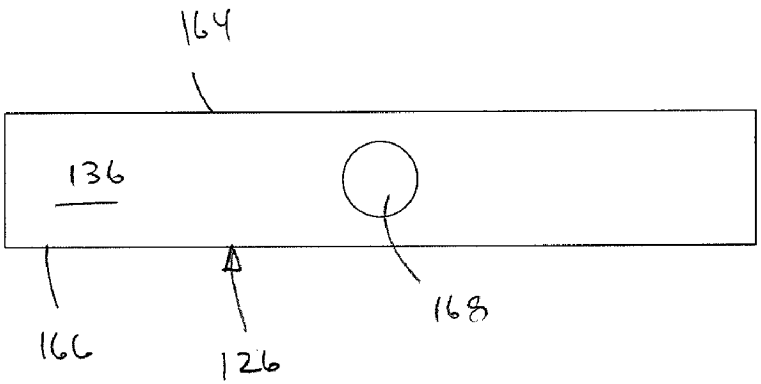
FIG. 10 is a bottom view of the upper block of FIG. 9.
Figure 11:
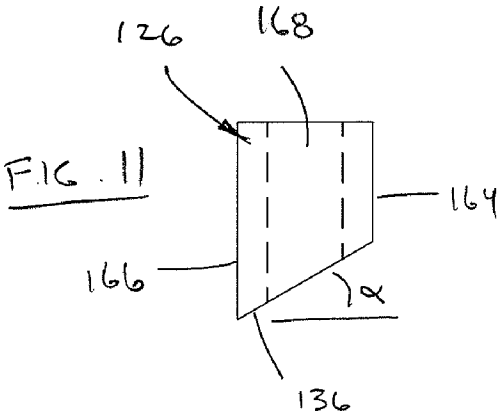
FIG. 11 is an end view of the upper block of FIG. 9.

Referring to FIGS. 9 to 11, upper block 126 includes a first side 164 and a second side 166. Second side 166 also defines an engagement surface to engage side walls 110 within slot 106. An opening 168 is provided through lower surface 136 to receive an upper end of screw 132. Lower surface 136 is angled at generally the same angle $\alpha$ with horizontal H, as shown in FIG. 11.

The general matching of angles $\alpha$ between lower surface 138 and upper surface 140 will urge center block 128 and lower block 130 in opposite directions when screw 132 pulls upper and lower blocks 126 and 130 toward each other and also maintain the alignment of engagement surfaces 160 and 154 of the lower and center blocks as the blocks are urged in opposite directions. Similarly, the general matching of angles $\alpha$ between upper surface 132 of center block 128 and lower surface 134 of upper block 126 will tend to maintain the alignment of engagement surfaces 154 and 166, of the central and upper blocks as the blocks are urged in opposite directions. Having upper and lower blocks 126 and 130 with the same angle $\alpha$ with regard to the sloped upper and lower surfaces of center block 128 will also help maintain a consistent angle of engagement surface 160 and 166 with regard to each other as they engage side wall 110 of slot 106.

Figure 12:
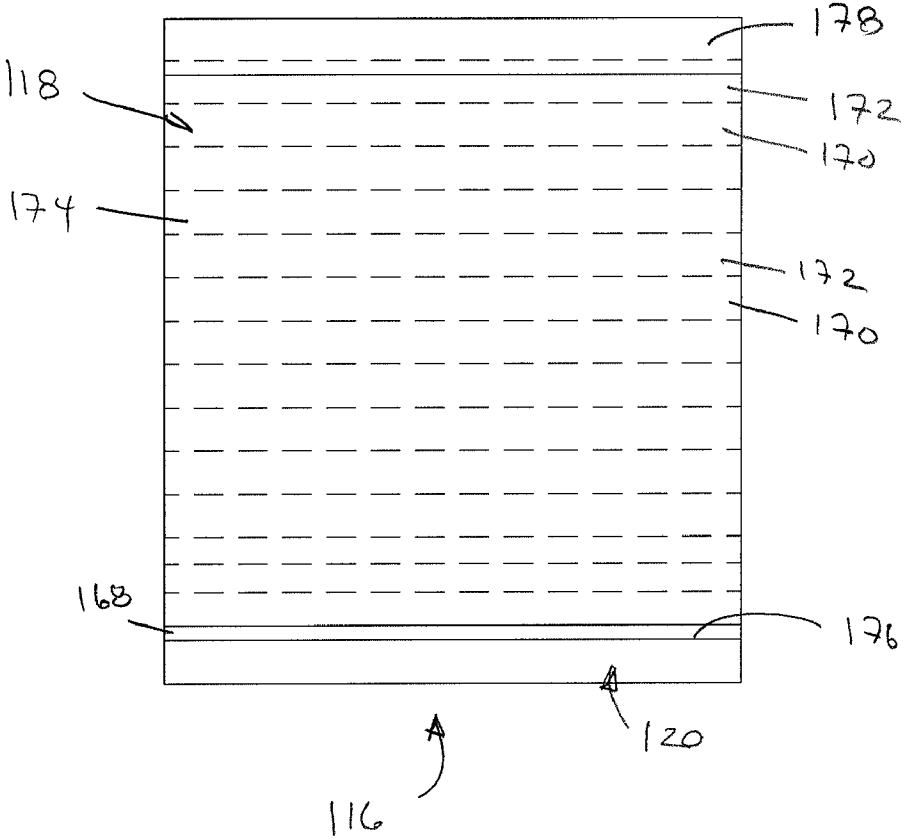
FIG. 12 is a side view of an isolator of the partition clamping system of FIG. 1.
Figure 13:
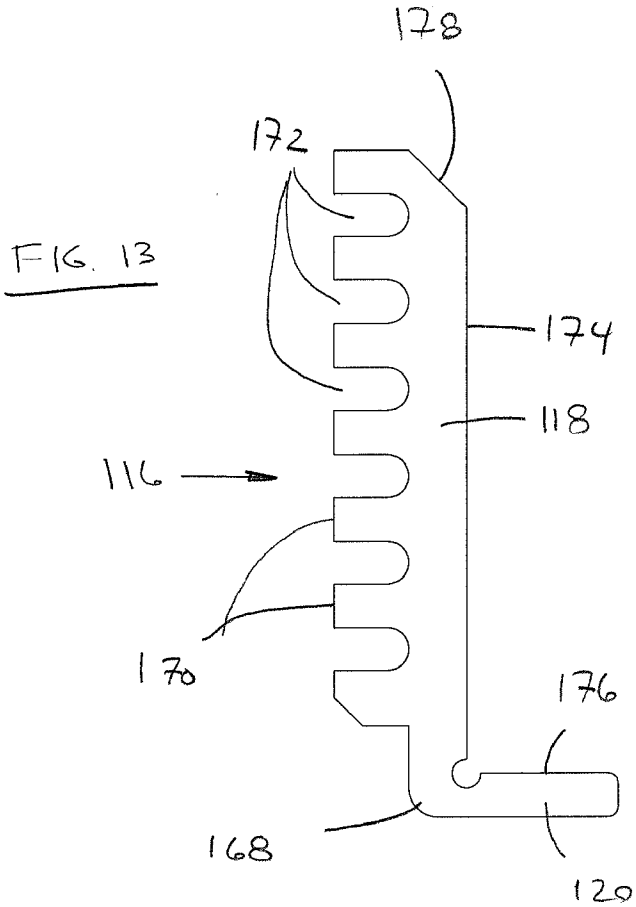
FIG. 13 is an end view of the isolator of FIG. 12.

Referring now to FIGS. 12 and 13, vertical portion 118 of first isolator 116 may be joined to lower portion 120 by a living hinge or other integral connection. Alternatively, the vertical and lower portions may be separate elements or they may be joined by a separate piece, but it is preferable to have isolator 116 comprised of these two elements linked together for ease of handling and installation. Vertical portion 118 includes an outer surface 170 configured to engage side wall 110 of slot 106. As shown, a number of grooves 172 may be formed in the outer surface to reduce the amount of material required to form the isolator, which may in turn result in a lower production costs and a lighter isolator. Opposite the outer surface is an inner surface configured to engage side 114 of partition 102. An inner surface 176 of lower portion 120 is configured to engage lower edge 108 of partition 102. A chamfer 178 may be added at an upper end of vertical portion 118 to ease entry of lower edge 108 of partition 102 into slot 106 during assembly.

FIGS. 14 to 16 illustrate isolator 142 for placement between engagement surface 154 of center block 128 and side 114 of partition 102. Isolator 142 is a simple rectangle of material with opposing side surfaces 180 configured engage either engagement surface 154 or side 114. Isolator 142 is preferably at least as large as engagement surface 154 and may be oversized as compared to this surface 154.

Isolators 116 and 142 cooperate with clamp system 122 to position partition 102 within slot 106. The thickness of the isolators may also be varied to accommodate thicker or thinner partitions 102 or lower edges 108 within the same size shoe 104. For example, two common glass partition sizes are nominally one half inch and three quarters of an inch. Use of different thicknesses of isolators and a sufficiently wide slot 106 will permit the same shoe 104 to accommodate and clamp both of these standard sizes and ensure that the partition is centered within the slot.

The cross-section of slot 106 as shown in FIGS. 1 and 2, above, illustrates an advantage offered by the disclosed clamping system. Conventional clamping systems for partitions, such as that shown in U.S. Pat. No. 7,036,799, may use a shoe with the same external dimension but with a slot only as wide as recess 150 in lower wall 112. Such a slot width is dictated by the conventional clamping systems based upon slim wedges inserted vertically between the partition and the shoe. This conventional approach results in much thicker sides to the shoe and a much greater weight per linear foot of the shoe. The novel approach to clamping a partition disclosed herein results in shoe 104 with much thinner upward extensions 148 and a much reduced weight per linear foot of shoe 104. Lighter shoes may result in easier and faster installation, as well as reduced material costs. In one illustrative example, the weight per linear foot of shoe 104 could be reduced by up to approximately thirty percent or more compared to shoes of conventional cross-section.

Figure 17:
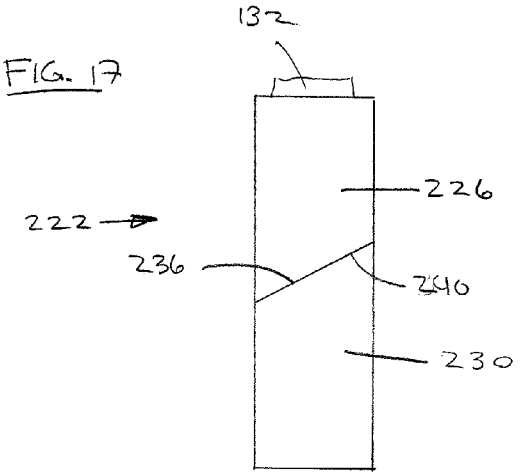
FIG. 17 is an end view of an alternative embodiment of a clamp assembly according to the present disclosure.

Referring now to FIG. 17, an alternative clamp system 222 is comprised of an upper block 226 and a lower block 230. A lower surface 236 of upper block 226 and an upper surface 240 of lower block 230 engage each other and cooperate to clamp partition 102 within slot 106 when screw 132 draws the two blocks toward each other.

Figure 18:
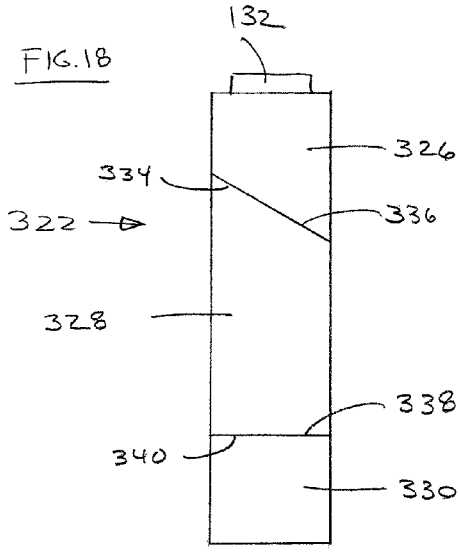
FIG. 18 is an end view of a second alternative embodiment of a clamp assembly according to the present disclosure.

FIG. 18 illustrates a second alternative clamp system 322 with an upper block 326, a center block 328 and a lower block 330. A sloped lower surface 336 of upper block 326 engages a sloped upper surface 334 of center block 328. A lower surface 338 of center block 328 engages an upper surface 340 of lower block 330. When screw 132 is rotated to draw the upper and lower blocks toward each other, the sloped surfaces 334 and 336 cooperate to urge center block 328 sideways and clamp partition 102. The non-sloped surfaces 338 and 340 cooperate to help maintain the angle and orientation of center block 328 as it engages side 114 of partition 102.

Figure 19:
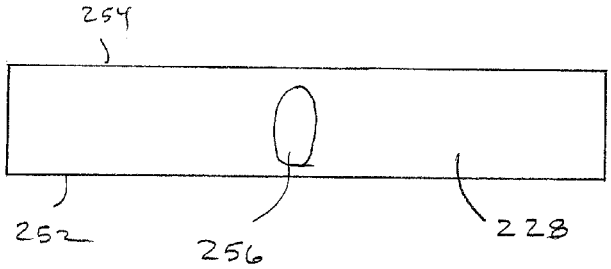
FIG. 19 is a top view of an alternative embodiment of a center block according to the present disclosure.
Figure 20:
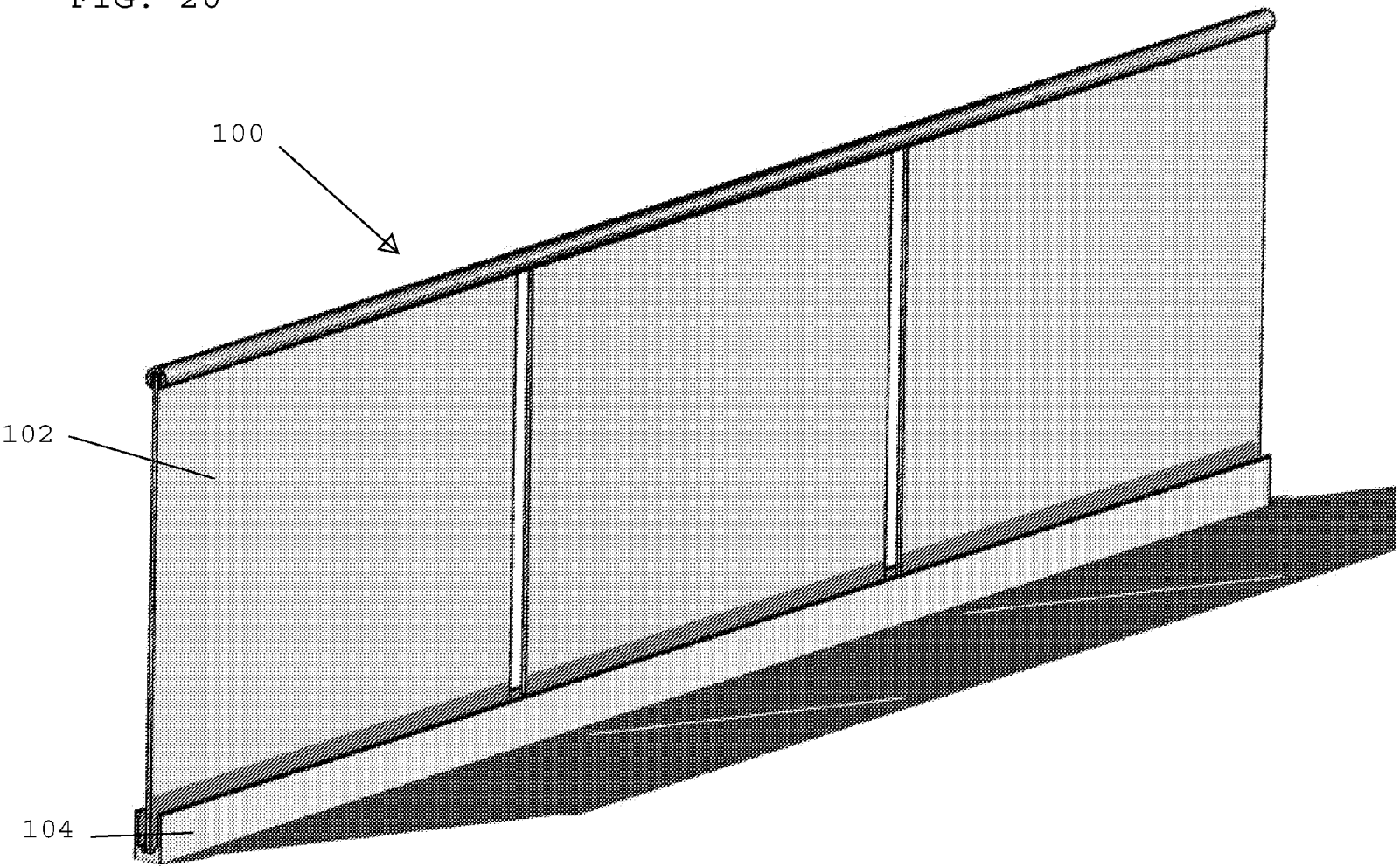
FIG. 20 is a perspective view of the partition mounting system of FIG. 1.
Figure 21:
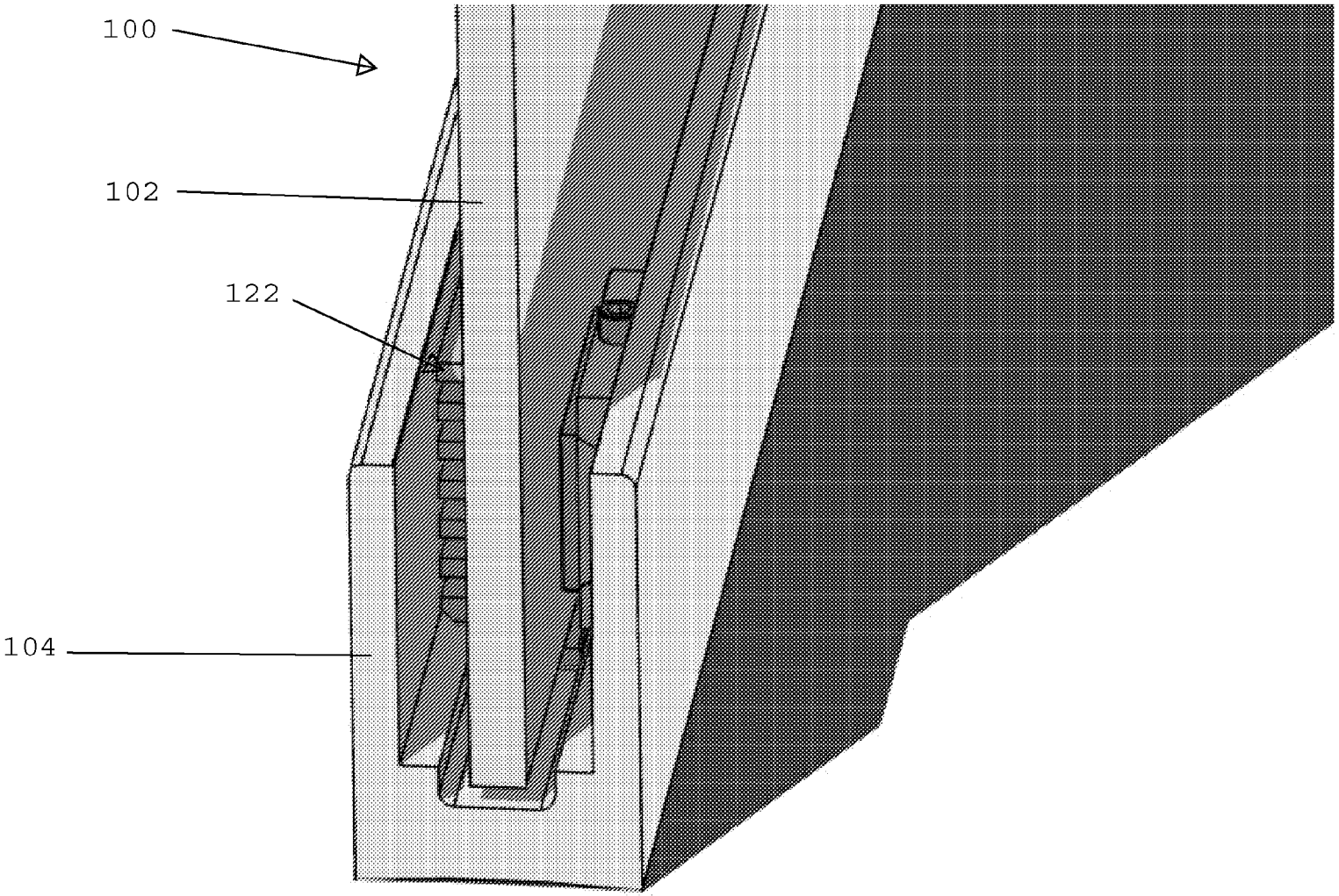
FIG. 21 is a second perspective view of the partition mounting system of FIG. 20.
Figure 22:
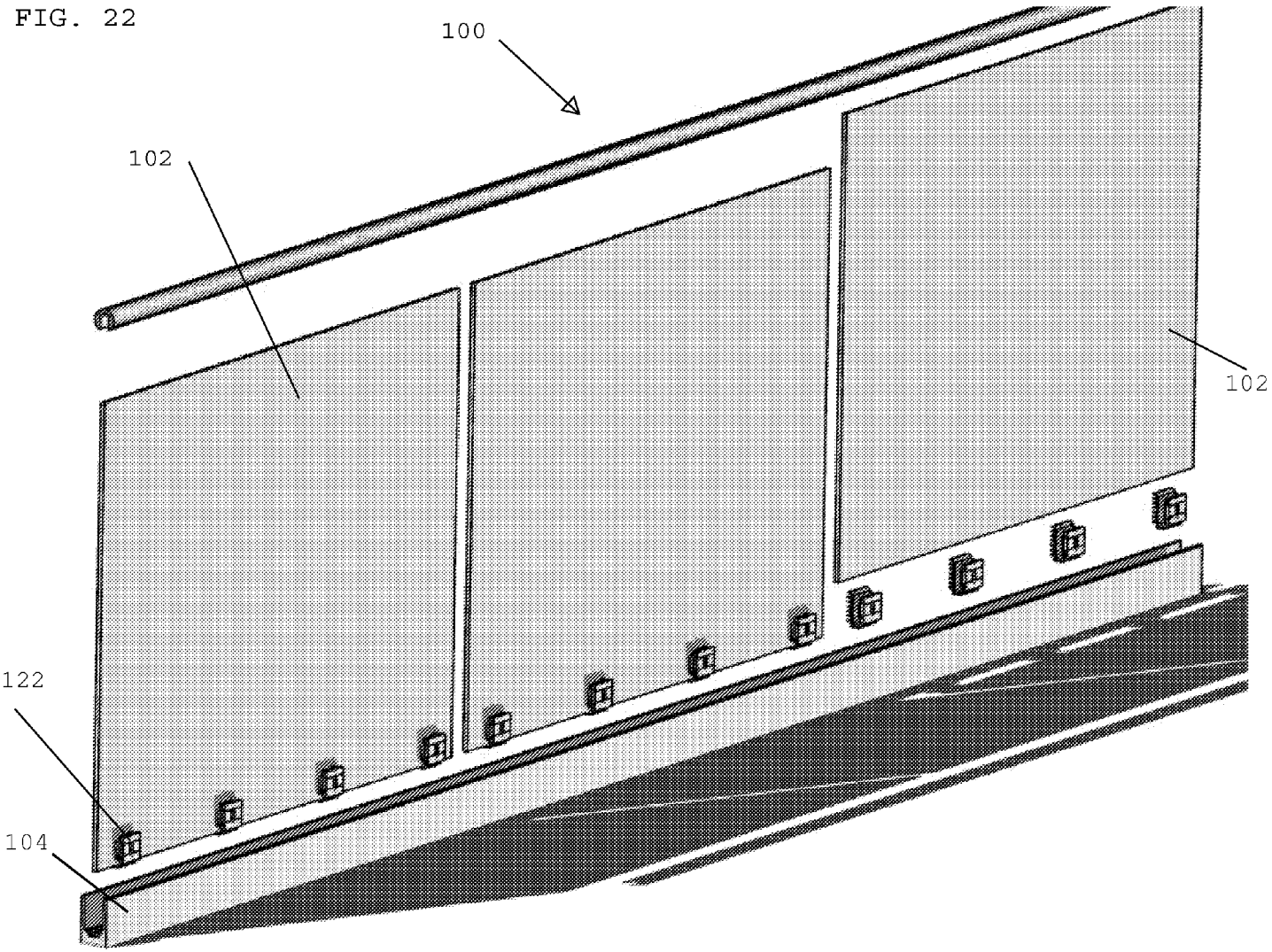
FIG. 22 is a first exploded perspective view of the partition mounting system of FIG. 20.
Figure 23:
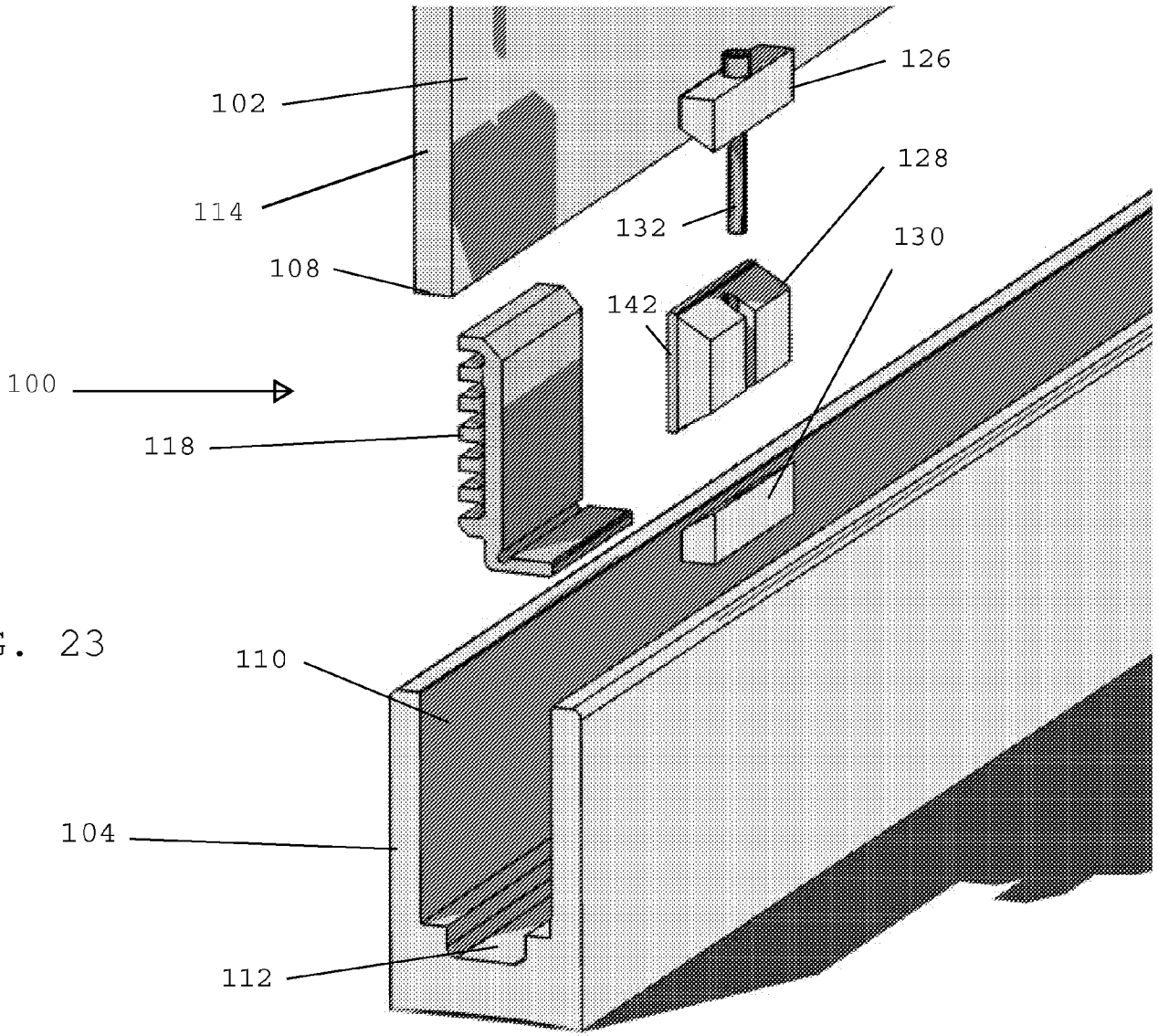
FIG. 23 is a second exploded perspective view of the partition mounting system of FIG. 20.

FIG. 19 illustrates an alternative embodiment of center block 228 with an opening 256 for receiving screw 132. Opening 256 is ovalized or elongated toward 252 and 254 to permit sideways movement of center block 228 when screw 132 draws the upper and lower blocks with respect to each other and to allow center block to clamp and release partition 102 within slot 106.

While the invention has been described with reference to preferred embodiments, it is to be understood that the invention is not intended to be limited to the specific embodiments set forth above. Thus, it is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

What is claimed is:

1. A partition mounting system for mounting a partition including a lower edge and a first side generally parallel to and spaced apart from a second opposite side adjacent the lower edge, the system comprising;

a shoe with an upward opening slot defined by a pair of spaced apart opposing side walls and a lower wall, the slot sized to receive the lower edge of the partition with each side of the partition adjacent one of the side walls of the shoe and the lower edge of the partition adjacent the lower wall of the shoe;

a clamp assembly positioned between the second side of the partition and its adjacent side wall of the shoe, the clamp assembly comprising:

a lower block;

a center block, positioned above the lower block;

an upper block positioned above a center block, and a screw extending generally vertically through the upper and center blocks and threadably engaged by the lower block;

the center block having a sloped upper surface and a sloped lower surface, the upper block having a lower surface engaging the sloped upper surface and the lower block having an upper surface engaging the sloped lower surface; and wherein rotation of the screw in a first direction draws the upper and lower blocks toward each other and the engagement between the upper block and the center block and the lower block and the center block operate to force an engagement surface of the center block against one of the side wall of the shoe and the side of the partition, and to force an engagement surface of the upper block and an engagement surface of the lower block against the other of the side wall and the side.

2. The system of claim 1, the center block further comprising a generally vertical groove for receiving the screw, the slot including an open side opposite the engagement surface.

3. The system of claim 1, the center block further comprising a generally vertical opening for receiving the screw, the opening elongated generally perpendicularly to the engagement surface.

4. The system of claim 1, further comprising the engagement surface of the center block toward the side of the partition and the engagement surfaces of the upper and lower blocks engaging the side wall of the slot.

5. The system of claim 4, further comprising a second isolator positioned between the side of the partition and the engagement surface of the center block.

6. The system of claim 1, further comprising an isolator positioned within the slot between the first side and its adjacent side wall and between the lower edge and the lower wall.

7. The system of claim 6, the isolator comprising a vertical portion extending between the slot and the partition opposite the clamp assembly, and a lower portion extending between the lower edge of the partition and the lower wall of the slot, the vertical portion and the lower portion formed integrally with each other.

8. The system of claim 7, further comprising the vertical portion of the isolator including a generally smooth engagement surface engaging the side of the partition, and an opposite surface for engaging the side wall of the slot.

9. The system of claim 1, further comprising the sloped upper and lower surfaces of the center block are angled with respect to horizontal between twenty and forty degrees.

10. The system of claim 9, wherein the sloped upper and lower surfaces of the center block are angled approximately thirty degrees with respect to horizontal.

11. The system of claim 9, wherein the lower surface of the upper block and the upper surface of the lower block are angled correspondingly to the sloped surface of the center block which they engage.

12. The system of claim 6, wherein the lower edge of the partition may be selected from a plurality of different thicknesses and the thickness of the isolator between the side of the partition selected and the side wall of the slot is selected to position the partition as desired within the sidewalls of the slot.

13. A clamp assembly for a partition mounting system, the system including a partition including a lower edge and a first side generally parallel to and spaced apart from a second opposite side adjacent the lower edge, a shoe with an upward opening slot defined by a pair of spaced apart opposing side walls and a lower wall, the slot sized to receive the lower edge of the partition with each side of the partition adjacent one of the side walls of the shoe and the lower edge of the partition adjacent the lower wall of the shoe, and a clamp assembly positioned between the second side of the partition and its adjacent side wall of the shoe, the clamp assembly comprising:

a lower block;

an upper block having a sloped lower surface; and positioned above the lower block, and a screw extending generally vertically through the upper block and threadably engaging the lower block wherein rotation of the screw in a first direction draws the upper and lower blocks toward each other and the blocks cooperate to exert a generally horizontal force against the one of the sides of the partition and the side wall of the slot.

14. The clamp assembly of claim 13, further comprising a center block positioned between the upper and lower blocks, the center block including a sloped upper surface engaging the sloped lower surface of the upper block, the center block including an opening through which the screw extends, wherein rotation of the screw in the first direction cooperates with the sloped surfaces of the blocks to urge the center block against the other of the sides of the partition and the side wall of the slot.

15. The clamp assembly of claim 13, wherein the lower block includes a sloped upper surface which engages the sloped lower surface of the upper block and rotation of the screw in the first direction urges the upper block against one of the side of the partition and the side wall of the slot, and urges the lower block against the other of the side of the partition and the side wall of the slot.

16. The clamp assembly of claim 14, the lower block further comprising a sloped upper surface and the center block a sloped lower surface, and the sloped surface of the blocks cooperate to urge the upper and lower blocks against one of the side of the partition and the side wall of the slot, and to urge the center block against the other of the side of the partition and the side wall of the slot.

17. The clamp assembly of claim 14, wherein the screw receiving opening of the center block is an ovalized opening.

18. The clamp assembly of claim 14, wherein the screw receiving opening of the center block is an open sided groove.

19. A clamp assembly for a partition mounting system, the system including a partition including a lower edge and a first side generally parallel to and spaced apart from a second opposite side adjacent the lower edge, a shoe with an upward opening slot defined by a pair of spaced apart opposing side walls and a lower wall, the slot sized to receive the lower edge of the partition with each side of the partition adjacent one of the side walls of the shoe and the lower edge of the partition adjacent the lower wall of the shoe, and a clamp assembly positioned between the second side of the partition and its adjacent side wall of the shoe, the clamp assembly comprising:

a lower block;

an upper block having a sloped lower surface; and positioned above the lower block, and means for drawing the upper and lower blocks toward each other, such that the blocks cooperate to exert a generally horizontal force against the one of the sides of the partition and the side wall of the slot.

20. The clamp assembly of claim 19 wherein the drawing means comprises a screw extending generally vertically through the upper block and threadably engaging the lower block, such that rotation of the screw in a first direction draws the upper and lower blocks toward each other and the blocks cooperate to exert the generally horizontal force.

* * * * *